US005471224A

United States Patent [19]

Barkeshli

[11] Patent Number: 5,471,224

[45] Date of Patent: Nov. 28, 1995

[54] FREQUENCY SELECTIVE SURFACE WITH REPEATING PATTERN OF CONCENTRIC CLOSED CONDUCTOR PATHS, AND ANTENNA HAVING THE SURFACE

[75] Inventor: Sina Barkeshli, Saratoga, Calif.

[73] Assignee: Space Systems/Loral Inc., Palo Alto, Calif.

[21] Appl. No.: 151,501

[22] Filed: Nov. 12, 1993

[51] Int. Cl.[6] ..... H01Q 15/02; H01Q 15/24

[52] U.S. Cl. ..... 343/909

[58] Field of Search ..... 343/909, 910, 343/911 R, 753, 754

[56] References Cited

U.S. PATENT DOCUMENTS

| | | | |
|---|---|---|---|
| 3,189,907 | 6/1965 | Buskirk | 343/753 |
| 3,394,378 | 7/1968 | Williams et al. | 343/909 X |
| 4,495,506 | 1/1985 | Sasser et al. | 343/909 |
| 5,130,718 | 7/1992 | Wu et al. | 343/909 X |
| 5,162,809 | 11/1992 | Wu | 343/909 |

FOREIGN PATENT DOCUMENTS

| | | | |
|---|---|---|---|
| 169206 | 9/1984 | Japan | 343/909 |

OTHER PUBLICATIONS

J. Huang, et al., "Tri–Band Frequency Selective Surface with Circular Ring Elements", IEEE, 1991, pp. 204–207.

*Primary Examiner*—Theodore M. Blum

*Attorney, Agent, or Firm*—Perman & Green

[57] ABSTRACT

A microwave element having a frequency selective surface (FSS) is formed of a substantially planar substrate of dielectric material which is transparent to electromagnetic radiation, and supports an array of radiators wherein the radiators are arranged in a plurality of sets of radiators. In each set of radiators, in a preferred embodiment, there are three concentric radiators fabricated of an electrically conductive material. The outermost radiator has a hexagonal closed form, and the inner radiators are configured as circular annuluses. In each set, the largest radiator has a circumference equal to a wavelength of a first frequency of radiation to be reflected from the (FSS), the sets being spaced apart by a spacing equal to one-third of the foregoing wavelength in the dielectric substrate. In a two-dimensional array of the sets of the radiators, the sets are located at vertices of equilateral triangles. An antenna incorporating the FSS includes a first horn operative at radiation of the foregoing wavelength and a reflector, both of which are disposed on one side of the FSS. Additional horns operative at higher frequencies located on the opposite side of the FSS for transmittal of radiation through the FSS.

17 Claims, 4 Drawing Sheets

FREQUENCY SELECTIVE SURFACE WITH REPEATING PATTERN OF CONCENTRIC CLOSED CONDUCTOR PATHS, AND ANTENNA HAVING THE SURFACE

BACKGROUND OF THE INVENTION

This invention relates to a frequency selective surface (FSS) capable of reflecting electromagnetic radiation at one frequency while transmitting radiation at another frequency and, more particularly, to a construction of such a surface by a repetitive pattern of nested sets of concentric circles and/or polygons of electrically conductive material disposed on a substrate of electromagnetically transmissive material, and to an antenna incorporating the FSS to operate at plural frequency bands.

Frequency selective surfaces have been constructed of arrays of radiating elements, or resonators, disposed on a supporting substrate of electromagnetically transmissive material. As an example of the use of such a surface, the surface may be employed in an antenna for directing radiation from two separate feeds, operating at different frequencies, to a common reflector during transmission and/or reception modes of operation of the antenna.

A problem arises in such an antenna in that the FSS is limited excessively in the amount of beam width which can be handled in the various frequency bands to be transmitted or received by the antenna. A further problem with such an antenna has been the requirement for an excessive amount of separation, in the frequency spectrum, between a band of radiation transmitted by the FSS and a band of radiation reflected by the FSS.

SUMMARY OF THE INVENTION

The aforementioned problems are overcome and other advantages are provided by a microwave frequency selective surface constructed of a generally planar substrate of dielectric material transparent to electromagnetic radiation, the substrate serving as a support for electromagnetically active radiating elements, or resonators, disposed on the substrate. The radiating elements are arranged in an array of repeating nested sets of radiating elements, each of which is configured as a closed path of electrically conductive material such as copper or aluminum, by way of example. The radiating elements may have the form of a hexagon, octagon, or polygon of still more sides including the limit of a circular closed path. In a preferred embodiment of the invention, each of the nested sets of radiating elements comprises two annular elements and a hexagonal element which are concentric. The elements are of successively larger size such that a smaller one of the annular elements is at the center of the set, a larger one of the annular elements encloses the central annular element, and the hexagonal element encloses both of the annular elements.

By constructing the largest element in each set with the shape of a hexagon, rather than a circle, the spacings between the sets can be reduced with a consequent reduction in the production of grating lobes in the radiation pattern. The circumference of the hexagon is equal approximately to a wavelength of the lowest frequency of a set of three frequency bands to be employed with the FSS. The wavelength herein is understood to be the wavelength within the dielectric material of the substrate. The mean circumference of the middle annular element is equal approximately to the wavelength of the middle band of the foregoing radiation frequencies, and the mean circumference of the smaller annular radiating element is equal approximately to the wavelength of radiation at the highest frequency band.

In the use of the FSS in the construction of an antenna having a plurality of sources of radiation sharing a common reflector, as in the case of a satellite communication system, the FSS is disposed to intercept propagation paths of rays of radiation from the transmitter feeds of the highest and the mid-band radiation frequency, these bands of radiation propagating through the FSS to impinge upon the reflector. On the opposite side of a plane of the FSS, there is disposed the receiver feed of the lowest frequency band of radiation, this band of radiation being reflected by the FSS to impinge upon the receiver feed. Typically, the feeds are constructed as horns operative in reciprocal fashion such that any one of the feeds, in the general case of such an antenna, can serve for transmission or reception of radiant signals. This configuration of antenna permits the transmitting horns of the various transmitters to be spaced apart from each other.

The use of an array of nested sets of radiating elements, rather than arrays of single radiating elements as is done in the prior art, provides for an operational characteristic to the FSS which is similar, in a mathematical sense, to the operational characteristic of a multiple pole filter such as is used in the filtering of electrical signals. Thus, there is cooperation among the three elements in each of the nested sets to provide for a broader bandwidth in each of the three frequency bands, and also to provide for an enlarged beam width for radiation transmission in each of the three frequency bands. The wide beam width is associated with the wide angle of incidence over the FSS. In particular, it is noted that the development of grating lobes which have served as limitations to beam width in antennas of the prior art have been reduced and/or moved away from the beam directions in the present invention. A specific bandwidth and beam width characteristic as a function of frequency can be provided by adjustment of the inner and outer radii in each of the annular radiating elements.

BRIEF DESCRIPTION OF THE DRAWING

The aforementioned aspects and other features of the invention are explained in the following description, taken in connection with the accompanying drawing wherein.

DETAILED DESCRIPTION OF THE INVENTION

Figure 1:
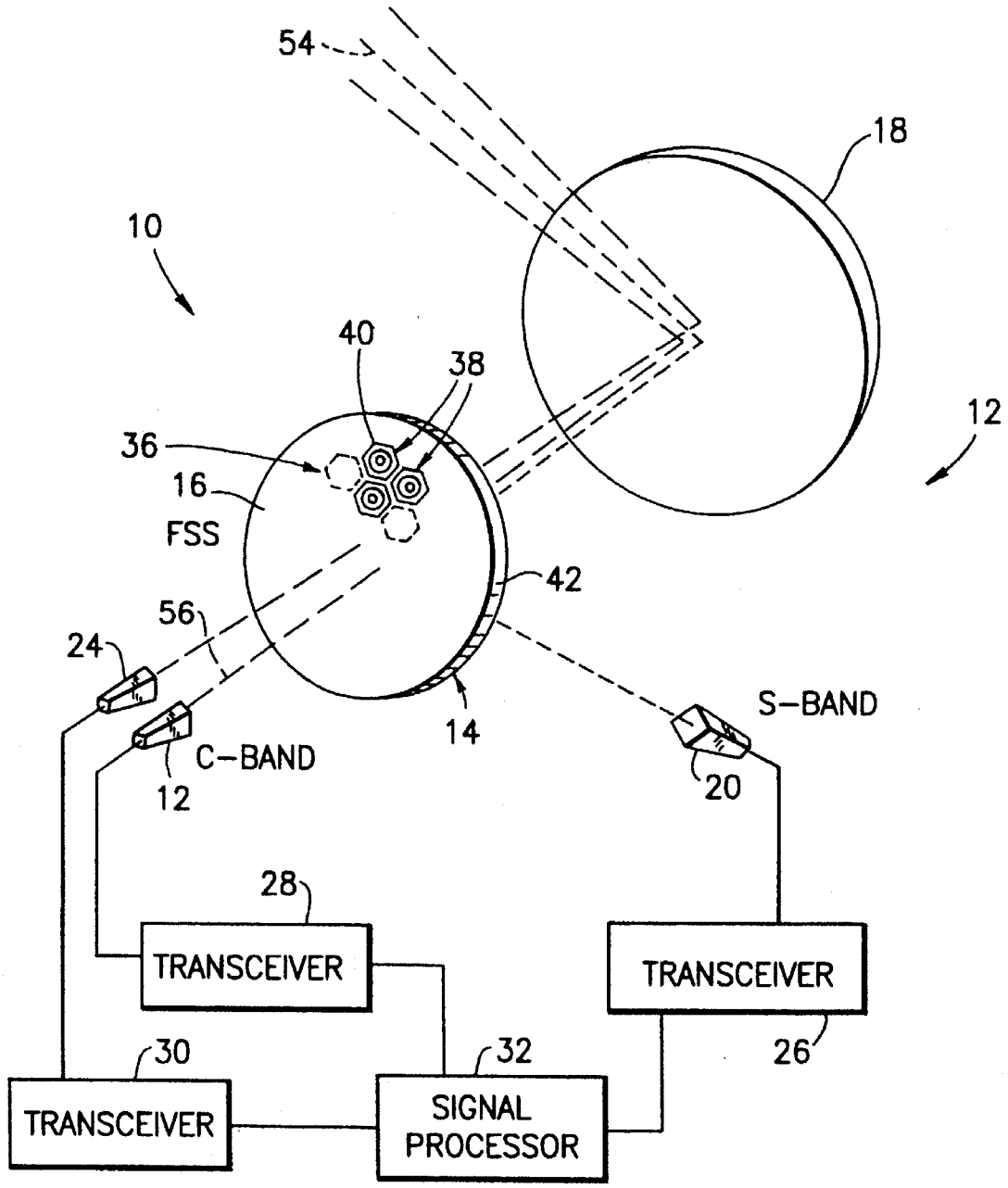
FIG. 1 presents an antenna system wherein an antenna incorporating the frequency selective surface of the invention is shown in a stylized perspective view, and other components of the system are indicated diagrammatically.

FIG. 1 shows an antenna system 10 suitable for operation on a satellite circling the earth. In accordance with the invention, the system 10 includes an antenna 12 having a frequency selective element 14. In accordance with the invention, the front surface 16 of the element 14 becomes a frequency selective surface (FSS) upon placement of radiators, or resonators, upon the surface 16 as will be described hereinafter. The FSS may be curved or planar; however, in the preferred embodiment of the invention, the element 14 including the FSS is constructed with a planar form. The antenna 12 further comprises a reflector 18 disposed behind the plane of the element 14, an S-band feed in the form of a horn 20 disposed also behind the plane of the element 14, a second horn 22 operative at a lower C-band spectral region and located in front of the plane of the element 14, and a third horn 24 operative in an upper C-band portion of the electromagnetic spectrum and being positioned also in front of the element 14. It is to be understood that the two C-band horns 22 and 24 are shown by way of example and that, if desired, the invention can be practiced by use of a single wide band horn or other form of feed encompassing the pass bands of both of the horns 22 and 24.

Generally, in satellite communications systems, one of a plurality of communication channel in one spectral band is employed for an up-link signal transmission, and another of the plurality of signal transmission bands is a separate portion of the electromagnetic spectrum is employed for the down-link transmission of signals. FIG. 1 indicates a generalized situation wherein any one of the spectral bands may be employed for either up-link or down-link transmission and, accordingly, the three horns 20, 22, and 24 are shown connected, respectively, to transceivers 26, 28, and 30. The transceivers 26, 28, and 30 are connected to a signal processor 32 which may provide the functions of modulation and demodulation of signals so as to transfer a signal from an up-link transmission band to a down-link transmission band for transmission back to a location on the earth.

Figure 2:
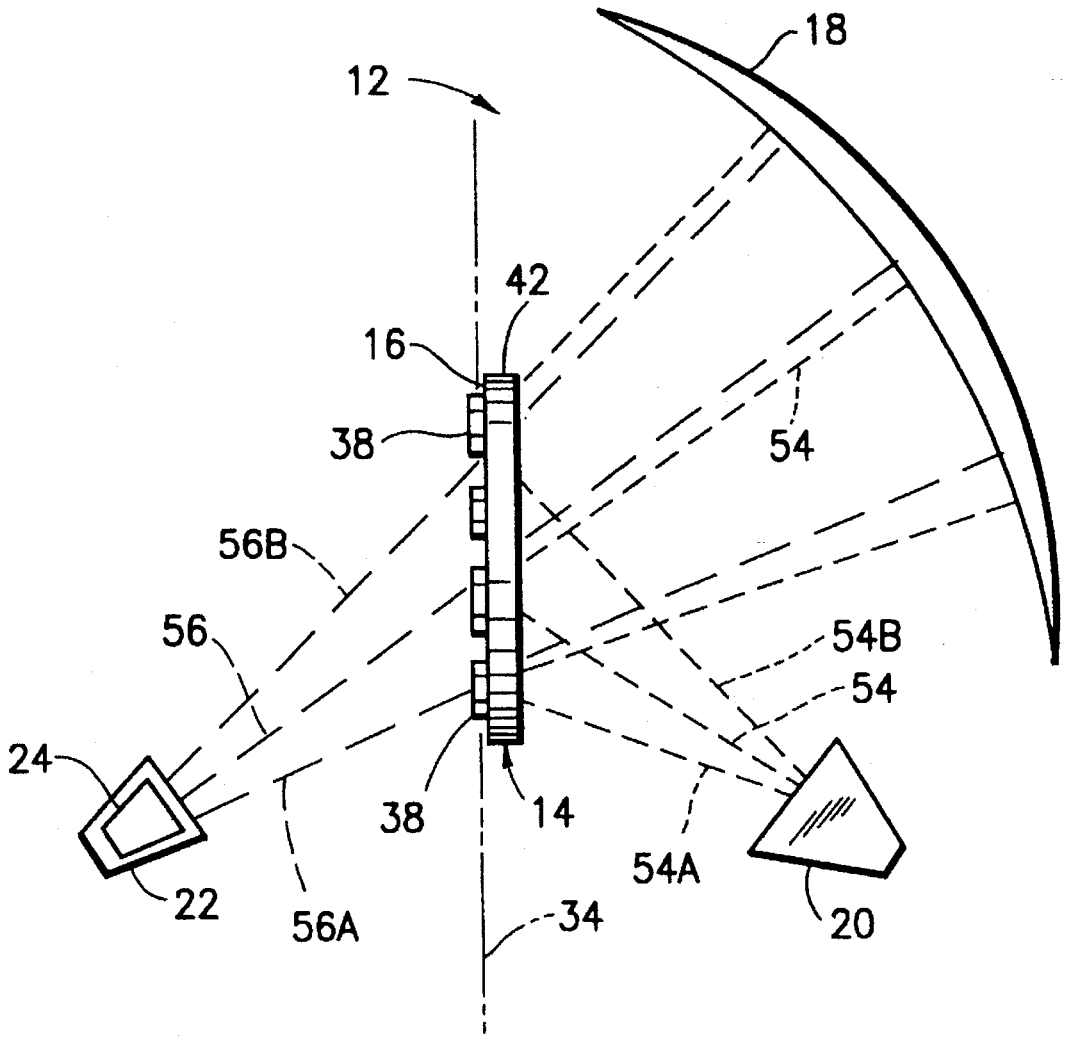
FIG. 2 is a diagrammatic sectional view of the antenna of FIG. 1.

FIG. 2 shows the positioning of the horn 20 behind a plane 34 of the front surface 16 of the frequency selective element 14, with the horns 22 and 24 located on the opposite side of the plane 34. Rays of radiation from the C-band horns 22 and 24 propagate directly through the element 14 to the reflector 18. Rays of radiation to the S-band horn 20 propagate along a path from the reflector 18 wherein the propagation path is folded by the FSS of the element 14 as the rays from the reflector 18 are reflected by the FSS to the horn 20. The locations of the S-band horn 20 and the cluster of the two C-band horns 22 and 24 are at mirror images of each other about the plane 34.

Figure 3:
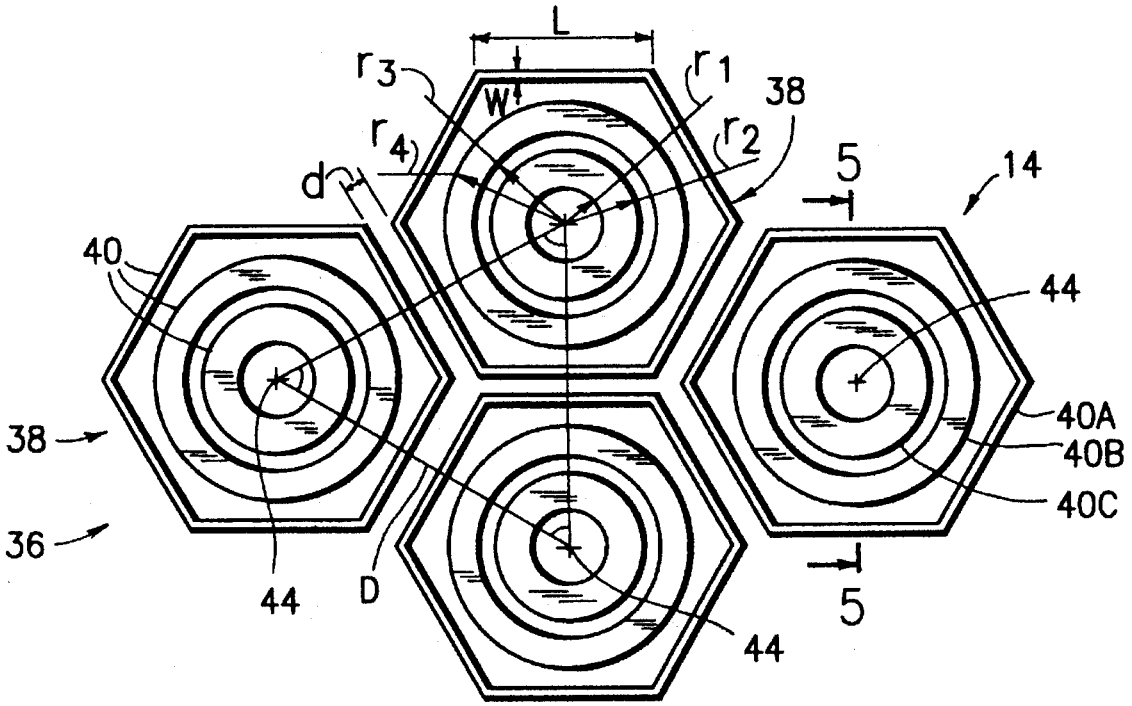
FIG. 3 is a plan view of a front surface of the frequency selective element of FIGS. 1 and 2, and wherein the supporting substrate has been deleted to simplify the figure to show the arrangement of radiating elements formed of electrically conductive material.
Figure 4:
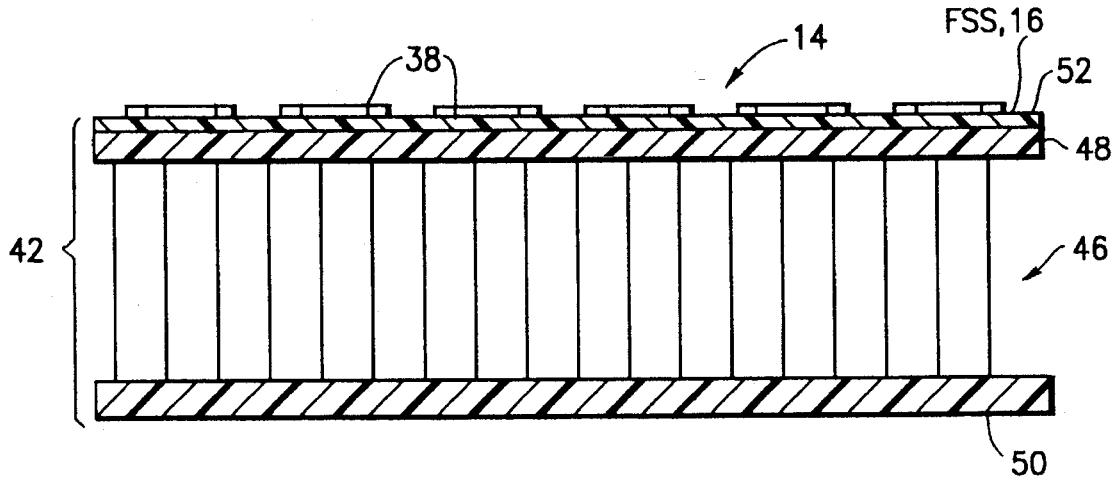
FIG. 4 is a sectional view of the frequency selective surface of FIGS. 1 and 2, the view including a substrate for supporting radiating elements on the front surface of the substrate, with the radiating elements being indicated diagrammatically.
Figure 5:
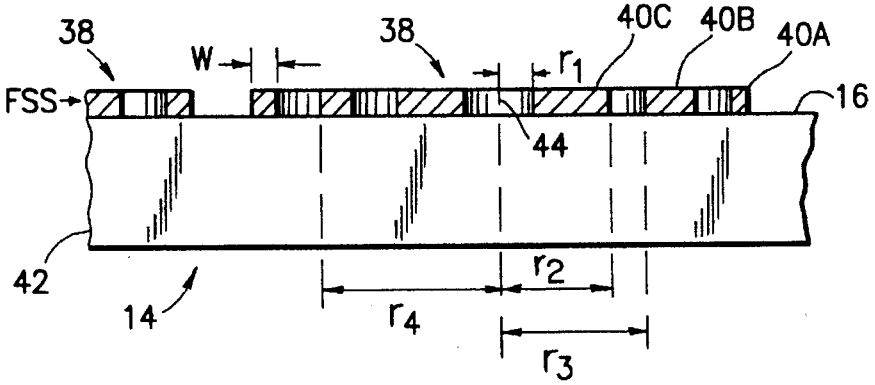
FIG. 5 is a sectional view taken along the line 5—5 in FIG. 3 showing one set of radiating elements in section with the substrate being indicated diagrammatically.

In accordance with the invention, and as shown in FIGS. 3–5, the front surface 16 of the element 14 is provided with an array 36 of sets 38 of radiating elements, or radiators, 40 wherein, in each of the sets 38, individual ones of the radiators are nested, one within the other. Each of the radiators is formed as a closed, generally circular path of electrically conductive material, a metal such as copper or aluminum being employed in the preferred embodiment of the invention. The radiators 40 are deposited on, and are supported by, a substrate 42 of the frequency-selective element 14. The substrate 42 is fabricated of dielectric materials, all of which are transparent to the electromagnetic radiation in the frequency bands of the horns 20, 22, and 24. Generally speaking, the radiators 40 may be circular, or slightly elliptical, or of polygonal shape. In the preferred embodiment of the invention, in each of the sets 38, there is a total of three radiators wherein an outermost one of the radiators 40A (shown in FIGS. 3 and 5) is provided with a hexagonal configuration, an innermost one of the radiators 40C (shown in FIGS. 3 and 5) is provided with a circular annular form, and the middle radiator 40B (shown in FIGS. 3 and 5) is provided also with a circular annular form. While, in the construction of each of the sets 38, it is possible to offset one radiator slightly from the other radiator, in the preferred embodiment of the invention, all of the radiators 40 are concentric with each other. Also, it is noted that the outermost radiator 40A may be circular, hexagonal, octagonal, or other polygonal form; however, the hexagonal form is employed in the preferred embodiment of the invention to permit a minimization of the spacing, D, (shown in FIG. 3) between centers 44 (shown in FIGS. 3 and 5) of the nested sets of radiators 40.

The spacing, D, between the centers 44, and the closest point of approach, d, between adjacent sets 38 are indicated in FIG. 3. The inner and the outer radii $r_1$ and $r_2$ of the innermost radiator 40C are shown in FIGS. 3 and 5. Similarly, the inner and outer radii $r_3$ and $r_4$ of the middle radiator 40B are indicated also in FIGS. 3 and 5. The difference in radii, $r_2-r_1$, and the difference in radii $r_4-r_3$ provide the width of the innermost and the middle radiators 40C and 40B. The width of the outermost radiator 40A is given by W, as shown in FIGS. 3 and 5. Adjacent ones of the sets 38 have their centers 44 arranged at the vertices of an equilateral triangle, as shown in FIG. 3, wherein each side of the triangle is identified by the distance D. The length L of one side of the hexagon of the outermost radiator 40A in any one of the sets 38 is shown also in FIG. 3.

As shown in FIG. 4 the substrate 42 has a lightweight rigid construction which is advantageous in satellite antenna systems. The substrate 42 comprises a central honeycomb core 46 enclosed on front and back sides by layers 48 and 50 of plastic film material, such as a polycarbonate, a layer of Kevlar being used in the construction of the front and back layers 48 and 50 in the preferred embodiment of the invention. A relatively thin layer 52 of plastic material such as nylon or Upilex is secured adhesively to the front layer 48 to serve as a bed for deposition of the nest 38 of the radiators 40, the Upilex being employed in the preferred embodiment of the invention. The honeycomb core 46 has a dielectric constant, similar to that of air, and may be formed of a material such as craft paper, such a material, Nomax being employed in a preferred embodiment of the invention.

The following dimensions are used in constructing an embodiment of the invention to operate at a specific set of spectral frequency bands, it being understood that, in accordance with the invention, the dimensions of the elements can be scaled to provide for an antenna which functions at higher or lower frequency bands. The S-band horn 20 operates at 2.65–2.69 GHz (gigahertz), and serves for receiving signals incident upon the antenna 12. The C-band horns 22 and 24 operate, respectively, in bands of 3.7–4.2 GHz and 5.925–6.425 GHz for transmission of electromagnetic signals from the antenna 12. All three of the horns 20, 22, and 24 are operative with circularly polarized waves. In the preferred embodiment of the invention, the radiators 40 are fabricated of copper film deposited in a layer in a range of typically 5–10 mil thickness. However, if desired, the thickness may be as low as one mil. The minimum thickness should be equal to at least a few times the electromagnetic skin depth of the copper film. In the outermost hexagonal radiator 40A, the length L of each side is equal approximately to one-sixth wavelength of the S-band radiation of the horn 20, this providing a value of L=0.430 in the preferred embodiment of the invention. The width, W, of the radiator 40A has a value in the range of 0.01–0.02 inch, a value of 0.015 inch being employed in the preferred embodiment of the invention. This provides for a circumference of the radiator 40A approximately equal to the wavelength of the S-band radiation within the dielectric material of the substrate, thereby enabling the radiator 40A to resonate at the frequency of the S-band radiation. In similar fashion, construction of the inner annular C-band radiators 40B and 40C with mean values of circumference equal approximately to mean values of their respective bands of radiation allow these radiators to resonate at their respective frequencies.

The distance D between the centers 44 is equal to 1.73L which is equal approximately to one-third wavelength of the S-band radiation in the dielectric substrate, these being equal approximately to 0.770 inches in the preferred embodiment of the invention. The closest point of approach, d, is equal to 15 mils. The radii $r_1$, $r_2$, $r_3$, and $r_4$, are equal respectively to 0.70 inches, 0.265 inches, 0.275 inches, and 0.335 inches. The following dimensions are used in the construction of the substrate 42. The Kevlar layers 48 and 50 each have a thickness in the range of 10–20 mils. The honeycomb core 46 has a thickness of one inch. The Upilex layer 52 has a thickness in the range of 1–2 mils. The dielectric constant of the layers 48, 50, and 52 is in the range of approximately 2.2–2.8.

In the operation of the antenna 12, an incoming ray 54 (FIGS. 1 and 2) is reflected by the reflector 18 to the element 14 wherein the FSS comprised of the radiator sets 38 acts to reflect the ray 54 to the horn 20. The ray 54 is represented by a dashed line wherein the dashes are relatively short. An outgoing ray 56 from the horn 22 propagates through the FSS and the element 14 to be reflected by the reflector 18 away from the antenna 12. The ray 56 is represented by a dashed line wherein the dashes are relatively long. In similar fashion, an outgoing ray from the horn 24 propagates through the FSS and the element 14 to be reflected by the reflector 18 away from the antenna 12.

As shown in FIG. 2, the horn 20 is capable of receiving radiation from rays anywhere within an input beam which converges to the horn 20 in which the beam width is identified by extreme rays 54A and 54B. In the preferred embodiment of the invention, the maximum angle of incidence of the extreme rays, either 54A or 54B, can be as high as 60° relative to a normal to the plane 34. The angle of 60° is substantially greater than that which has been available heretofore in the prior art, and represents a significant improvement in the utilization of an antenna, such as the antenna 12, for viewing a part of the earth's surface. In similar fashion, the beam width of radiation to be emitted by either of the radiators 22 and 24, and to be transmitted through the FSS, is comparable in size to the aforementioned beam width of the horn 20. This is indicated in FIG. 2 by extreme rays 56A and 56B, these rays being drawn as dashed lines with relatively large dashes to distinguish these rays from the S-band rays 54, 54A and 54B.

As can be seen in FIG. 3, the spacing between the radiators 40 in each of the sets 38 is substantially smaller than a quarter wavelength of the radiation in the highest frequency band, Thus, there is significant interaction among the radiators which, in terms of a mathematical analogy with the components of resistance, capacitance, and inductance of an electronic filter, provide for an overall reflectance/transmission characteristic of the frequency selective element 14 resembling that of a three-pole electronics filter. In the case of an electronics filter, movement of the poles and the zeros in the frequency-transform plane produces a filter response in which a steep transition may occur between a passband and a stop band of the filter.

By analogy, adjustment of the radii $r_1$, $r_2$, $r_3$ and $r_4$ within the confines of the outer hexagonal radiator 40A adjusts the frequency response of the element 14 to narrow the spectral spacing between the S-band reflection characteristic of the element 14 and the C-band transmission characteristic of the element 14. Thus, with respect to the foregoing transmission bands of the preferred embodiment of the invention, the highest reflection frequency is approximately 2.7 GHz while the lowest transmission frequency is 3.7 GHz, this giving a ratio of the two frequencies of 1.37 which is substantially lower that which has been obtainable in the prior art. A measure of the improved bandwidth of the frequency selective element 14 is obtained by dividing the maximum transmission frequency of approximately 6.4 GHz by the maximum reflection frequency of approximately 2.7 GHz to give a ratio of 2.37 which is significantly higher than that obtainable in the prior art. Also, the spacing and relative sizes of the radiating elements 40A, 40B, and 40C in respective ones of the sets 38 provides for greater control over grating lobes to attain the aforementioned benefit of the capacity to handle increased angles of incidence of the S-band and the C-band rays 54 and 56 (FIG. 2) relative to the frequency selective element 14.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A microwave frequency selective element being reflective in a first frequency band and transmissive in a second frequency band different from said first frequency band, comprising:

a substantially periodic array of sets of radiators disposed along a surface of the element, wherein each of the sets of the radiators comprises at least two radiators of which one radiator is an innermost radiator and a second radiator is an outermost radiator which encircles the innermost radiator, each radiator having a configuration which encircles a point on the surface of the element;

wherein said second frequency band is lower than said first frequency band, and the outermost radiator has a circumference approximately equal to a wavelength of radiation in the lower one of said frequency bands.

2. A frequency selective element according to claim 1 wherein said element is operative to reflect radiation in said lower one of said frequency bands.

3. A frequency selective element according to claim 2 wherein, in each of said sets of radiators, all of the radiators are concentric about a common center of the set.

4. A frequency selective element according to claim 3 wherein centers of adjacent sets are spaced apart by approximately one-third wavelength of the radiation of the lower one of said frequency bands.

5. A frequency selective element according to claim 4 wherein the surface of said element is planar.

6. A frequency selective element according to claim 5 wherein, in each of said sets of radiators, the innermost one of said radiators is circular.

7. A frequency selective element according to claim 6 wherein, in each of said sets of radiators, the outermost one of said radiators is hexagonal.

8. A frequency selective element according to claim 5 wherein, in each of said sets of radiators, there is a middle radiator disposed between said innermost radiator and said outermost radiator, said outermost radiator being hexagonal, said innermost radiator being circular, and said middle radiator being circular.

9. A frequency selective element according to claim 8 wherein, said innermost radiator has a configuration of a circular annulus, the annulus having an inner radius of curvature and an outer radius of curvature, and said middle radiator has the shape of a circular annulus, there being a spacing between said innermost radiator and said middle radiator, and wherein a width of the said innermost radiator, as measured by a difference between the inner and the outer radii of said innermost radiator, is greater than a width of the middle radiator.

10. A frequency selective element according to claim 9 wherein a width of said middle radiator is greater than a width of said outermost radiator.

11. A frequency selective element according to claim 10 further comprising a substrate for supporting said radiators, said substrate comprising a material transparent to the radiation in each of said frequency bands.

12. A frequency selective element according to claim 8 operative with radiation of a third frequency band lying between said first frequency band and said second frequency band and, wherein, a mean circumference of said innermost radiator is approximately equal to a wavelength of radiation at a highest one of said frequency bands, and a mean circumference of said middle radiator is approximately equal to a wavelength of the radiation in said third frequency band.

13. A frequency selective element according to claim 12 wherein said array of sets of radiators is a two-dimensional array, and said sets of radiators are arranged at vertices of equilateral triangles in said array.

14. A frequency selective element according to claim 1 wherein, in each of said sets of radiators, the innermost one of said radiators is circular and the outermost one of said radiators is polygonal, said array of sets of radiators is a two-dimensional array, and said sets of radiators are arranged at vertices of equilateral triangles in said array.

15. An antenna comprising a reflector, a frequency selective element, and a plurality of microwave feeds positioned for illuminating said reflector wherein a first of said feeds operative at a higher frequency of radiation is located on a side of said frequency selective element opposite said reflector to permit illumination of said reflector by transmittal of radiation through said frequency selective element, and wherein a second of said feeds operative at a lower frequency of radiation and said reflector are positioned on a common side of said frequency selective element opposite said first feed for permitting illumination of said reflector by reflection of radiation at said lower frequency by said frequency selective element, and wherein said frequency selective element comprises:

a substantially periodic array of sets of radiators disposed along a surface of said element, wherein each of the sets of the radiators comprises at least two radiators of which one radiator is an innermost radiator and a second radiator is an outermost radiator which encircles the innermost radiator, each of said radiators having a configuration which encircles a point on the surface of said element; and wherein the outermost one of said radiators has a circumference approximately equal to a wavelength of the radiation at said lower frequency, said sets of radiators being spaced apart by a spacing equal approximately to one-half wavelength of the radiation at said lower frequency.

16. An antenna according to claim 15 wherein, in each of said sets of radiators, there is a middle radiator disposed between said innermost radiator and said outermost radiator, said outermost radiator being hexagonal, said innermost radiator being circular, and said middle radiator being circular.

17. An antenna according to claim 15 wherein, in each of said sets of radiators, the innermost one of said radiators is circular and the outermost one of said radiators is polygonal, said array of sets of radiators is a two-dimensional array, and said sets of radiators are arranged at vertices of equilateral triangles in said array.

* * * * *